United States Patent [19]

Hankins

[11] 3,962,848

[45] June 15, 1976

[54] ENVELOPE FLAP PROCESSING APPARATUS

[76] Inventor: Charles William Hankins, 1218 Mission Road, South San Francisco, Calif. 94080

[22] Filed: Mar. 31, 1975

[21] Appl. No.: 563,575

[52] U.S. Cl. ..... 53/266 A; 53/381 R; 93/61 R; 271/112

[51] Int. Cl.[2] ..... B65B 7/00; B31B 1/76

[58] Field of Search ..... 53/381 R, 266 A, 188; 93/61 R; 271/112, 119

[56] References Cited

UNITED STATES PATENTS

| | | | |
|---|---|---|---|
| 673,604 | 5/1901 | Ielfield | 271/112 |
| 3,015,926 | 1/1962 | Galambos | 53/266 A X |
| 3,382,126 | 5/1968 | Hackmann | 53/266 A X |
| 3,410,053 | 11/1968 | Bonsch | 53/266 A |
| 3,747,297 | 7/1973 | Hankins | 53/381 R |

*Primary Examiner*—Leon Gilden
*Attorney, Agent, or Firm*—Warren J. Krauss

[57] ABSTRACT

Apparatus for automatically opening and closing the flaps of a plurality of mailing envelopes. The apparatus includes means for forcing open flaps which have become stuck to the associated envelope body and has means for closing the flaps of such envelopes. Storage means are provided for handling envelopes in large volume and automatic feeder means are provided for feeding said envelopes into a flap processing section of the apparatus. Material flattening and ejection means automatically draw the processed envelopes through the feeder means and flap processing sections and eject said envelopes from the device by way of a conveying section after the flaps thereon have been processed.

27 Claims, 12 Drawing Figures

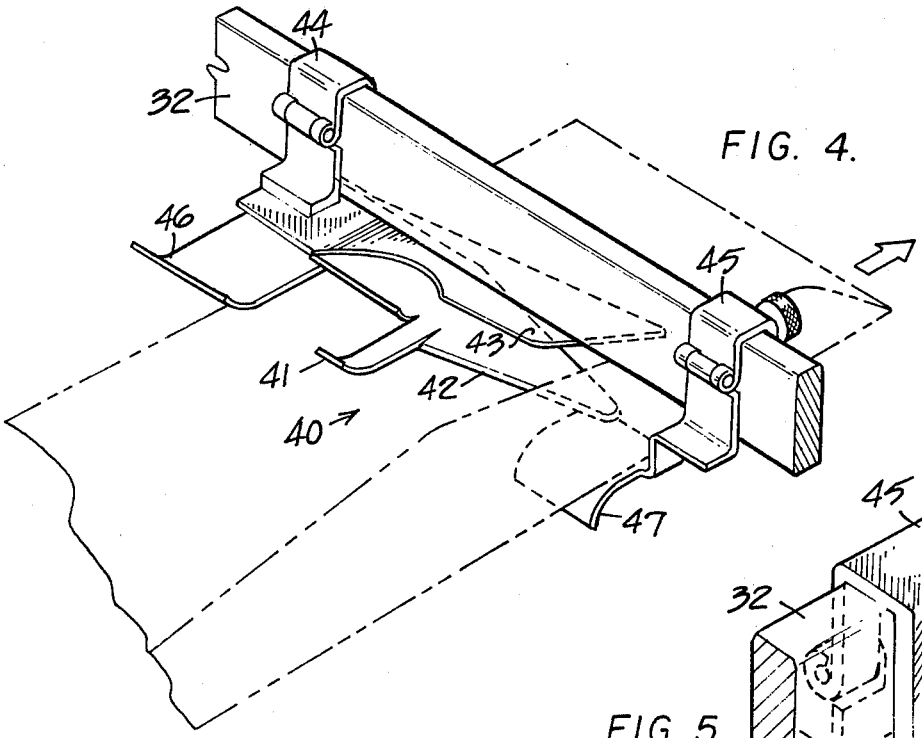
FIG. 4.
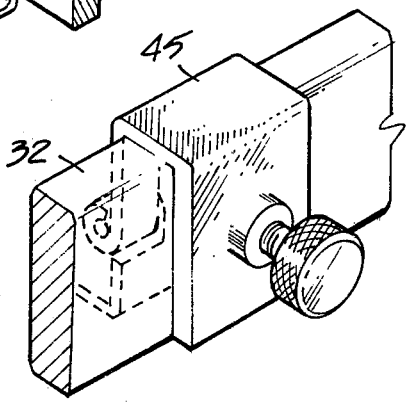
FIG. 5.
FIG. 6.
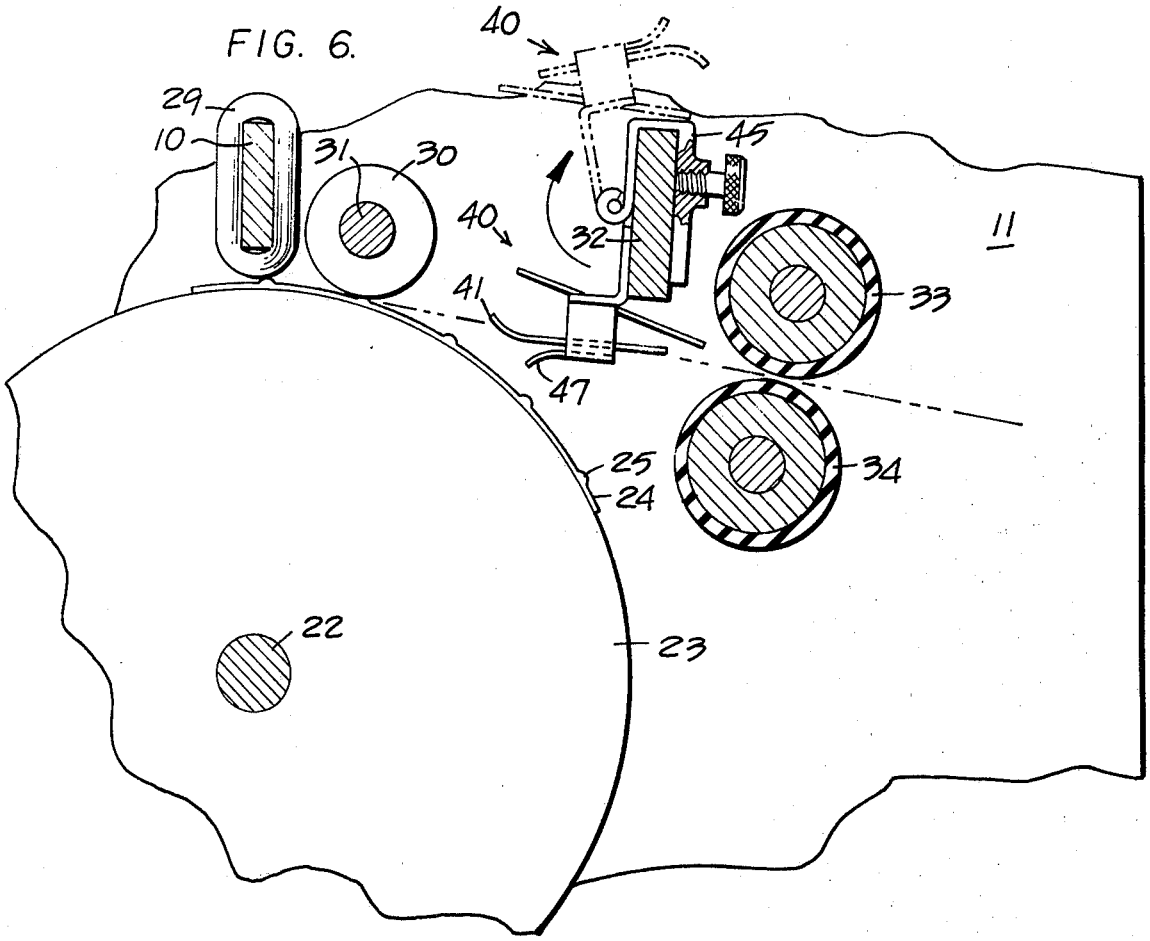

ENVELOPE FLAP PROCESSING APPARATUS

CROSS REFERENCE TO RELATED APPLICATION

This application relates to and improves upon U.S. application Ser. No. 199,971 entitled FLAP-OPENING APPARATUS filed Nov. 18, 1971 by Charles Williams Hankins, the present applicant, and issued as U.S. Pat. No. 3,747,297 on July 24, 1973.

BACKGROUND OF THE INVENTION

This invention relates to an apparatus for automatically opening the flaps of envelopes. It also relates to an apparatus capable of automatically cutting open envelope flaps which have been "stuck" together to the envelope body. And it also relates to an apparatus having means to automatically closing the flap of envelopes.

A fast and economical approach to the problem of opening the flaps of a large volume of envelopes has eluded industry for some time. The problem has been particularly vexing for mail order operations and other large organizations where large scale recurrent billing is required.

Generally, envelopes are supplied to the user in boxes with the flaps disposed in a normally closed position. This is because the gummed portion of the average envelope flap must be protected from ambient moisture during storage and such protection is afforded by the outer paper surfaces of the envelope when the envelope flap is in the normally-closed position. As a consequence, mailing operations usually involve the pre-opening or "flapping" of each individual envelope prior to the insertion therein of the material to be sent. Traditionally, this flapping has been accomplished, even in large volume situations, by manual means.

In the typical large volume mailing operation, teams of workers are periodically hired or are diverted from other tasks for the sole purpose of opening the flaps of envelopes. It is rather obvious that such a system is an extremely costly and inefficient solution to the "flapping" problem. Thus, industry has long sought a cheaper and more efficient system for efficiently processing large volumes of envelopes. The present invention is directed to, inter alia, the provision of such an improved system and, in particular, to an apparatus capable of automatically performing functions formerly carried out by manual means.

Another problem faced in large volume mailing operations may be attributed to the occasional propensity for a certain number of envelopes to be supplied to a processor with the gummed portions of the flaps stuck to the envelope bodies because of excessive glue application at the time of manufacture or because of exposure of the envelopes to moisture during warehousing. In such cases, it has been necessary to break or cut the stuck portions of the envelope flaps before the flaps could be opened for material insertion or "stuffing". The present invention is also directed to a means for the high speed recurrent cutting or breaking of such stuck flap envelopes prior to performance of the normal "flapping" operations.

The present invention is also directed to a device which will automatically reclose the flaps of envelopes after such flaps have been printed upon or material has been inserted into such envelopes.

SUMMARY AND OBJECTS OF THE INVENTION

The instant flap processing apparatus comprises a variable capacity envelope storage section which holds a plurality of envelopes having their flaps in a normally closed position, a flap processing section, a feeder section which automatically draws each individual envelope through the flap processing section, and a conveying section which transports the processed envelopes to a point of alternate utilization. Subsequent to passage through the flap processing and feeder sections of the apparatus, the processed envelopes are passed through a flattening and ejection means which flattens each of the envelopes in the processed condition and ejects the processed envelopes in an orderly fashion onto the conveying means. The apparatus may be actuated in a fully automatic mode by means of a suitable motor and control means.

The primary object of the present invention is to provide an apparatus for automatically "flapping" the flaps of a large volume of envelopes.

Another object of the present invention is to provide an apparatus having means for the automatic and high speed breaking or cutting-open of flaps of envelopes which have become stuck to the envelope bodies.

A further object of the present invention is to provide an apparatus having means for automatically closing the opened flaps of envelopes.

Other objects and advantages of the present invention will become apparent from the following drawings and description.

The accompanying drawings show, by way of illustration, the preferred embodiments of the present invention and the principles thereof. It should be recognized that other embodiments of the invention, applying the same or equivalent principles, may be used and that structural changes may be made as desired by those skilled in the art without departing from the spirit of the invention.

BRIEF DESCRIPTION OF THE DRAWINGS

FIG. 4 is an enlarged partial view of a portion of the flap-processing section of the apparatus showing in detail the inventive stuck flap opening means;

FIG. 5 is an enlarged isometric view of a portion of the retaining means for the stuck flap opening means shown in FIG. 4;

FIG. 6 is a partial sectional view taken along the line VI—VI of FIG. 1;

DETAILED DESCRIPTION

Figures 1, 2, 3:
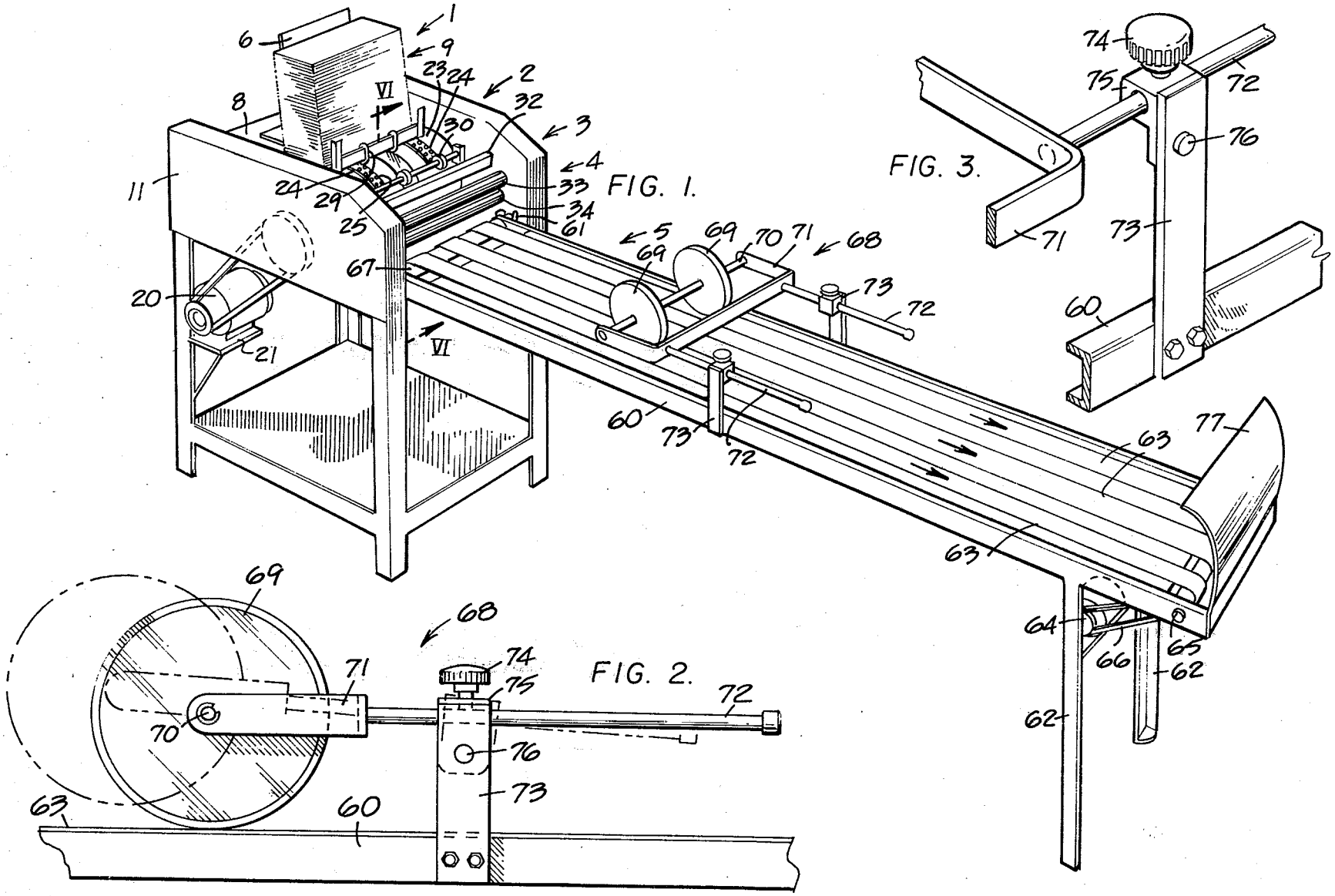
FIG. 1 is an isometric view of the present flap processing apparatus.
FIG. 2 is an enlarged partial view of a portion of the conveying section of the apparatus.
FIG. 3 is an isometric partially cut-away view of the elements shown in FIG. 2.

With reference to FIG. 1 in the drawings, the preferred embodiment of the instant invention will now be presented. The particular embodiment shown is comprised of five main sections shown generally at 1, 2, 3, 4, and 5. These are, respectively, an envelope storage section, a flap processing section, a feeding section, a flattening and ejection section, and a conveying section. The storage section generally comprises a bin or chute member 6 (see FIG. 8) which is adjustably mounted by means of suitable fastening means 7 upon a frame member or table portion 8. The member 6 may be moved longitudinally along the length of the table 8 as desired to provide a variable capacity for envelopes of various sizes and configurations.

Figure 8:
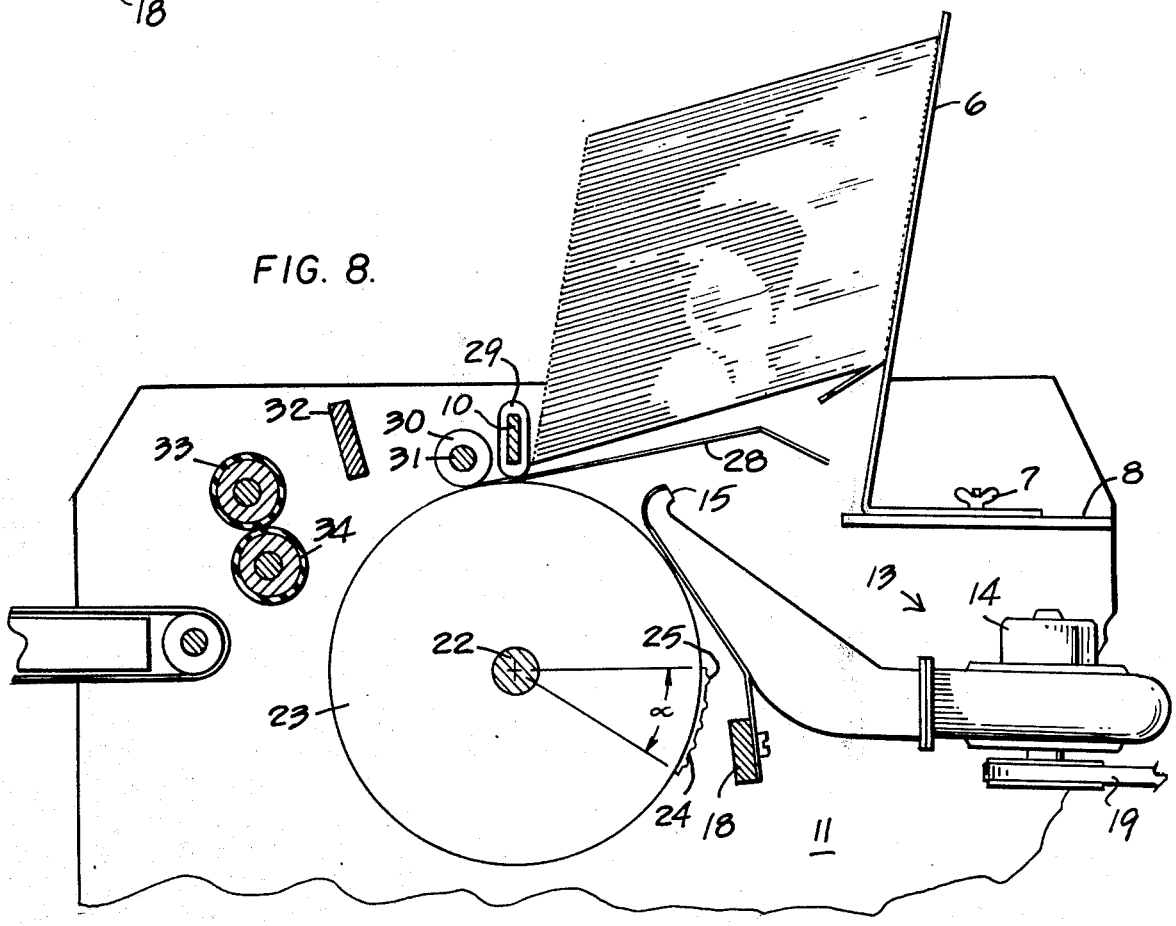
FIG. 8 is a partial sectional view of the apparatus showing the envelope storage, processing, and ejection sections thereof.

With further reference to FIG. 8, one can appreciate the manner in which envelopes which are to be opened or "flapped" are stored against the chute member 6. The envelopes, shown generally at 9, are stored flap down and inclined rearwardly upwardly by virtue of the oblique disposition of the chute member 6 with respect to the table portion 8. The forward portion of the envelope storage section is comprised of a plate member 10. Such plate member structure is mounted upon another portion of the apparatus frame structure 11 by suitable adjustable fastening means (not shown) so that the position of the plate member may be adjusted upwardly and downwardly with respect to the table portion 8. The aforementioned U.S. Pat. No. 3,747,297 to the present inventor shows suitable adjustable mounting means for the plate structure.

Figure 7:
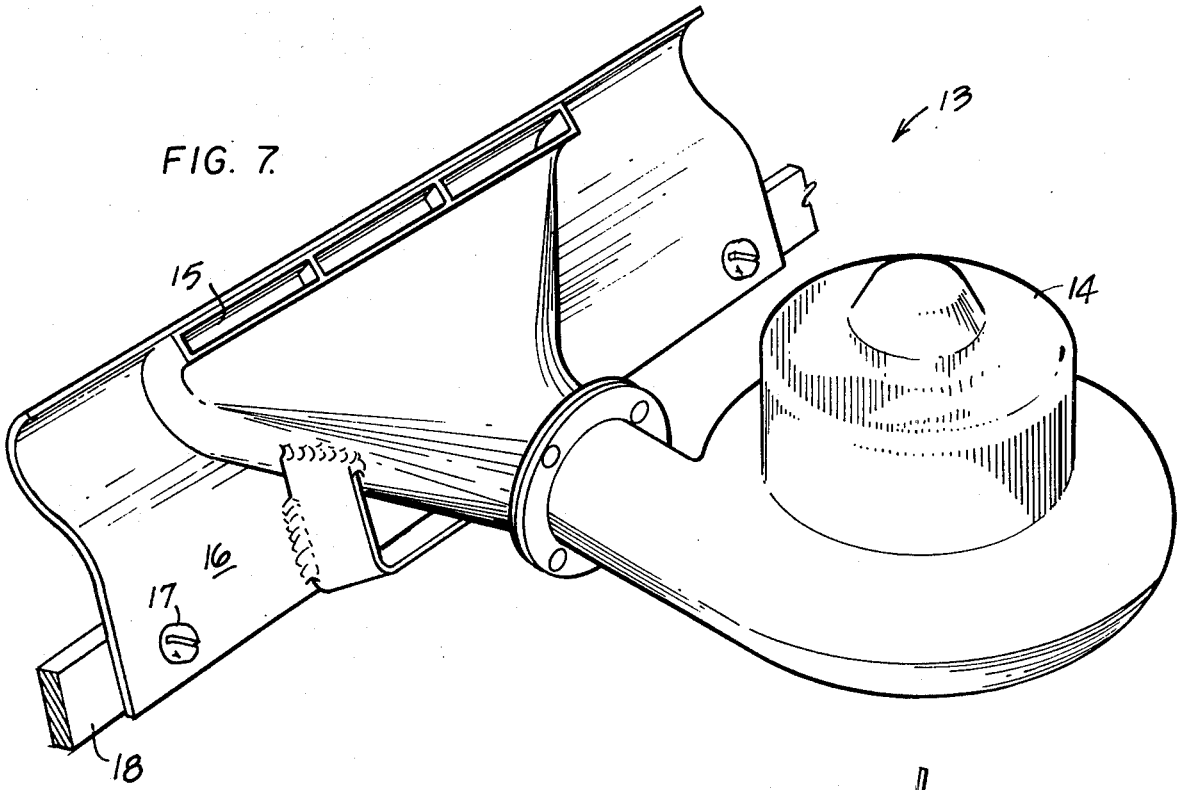
FIG. 7 is an enlarged isometric view of the flap opening vacuum means of the present invention.

With concurrent reference to FIGS. 1, 7, and 8, the flap processing section of the apparatus may be appreciated. A suction or vacuum device, shown generally at 13 in FIG. 7, comprises, in the preferred embodiment, an electric fan device 14 having a flared and sectional inlet portion 15 and having an axially disposed outlet. The fan device could be any number of commercially available electrically driven rotary devices. The vacuum device is attached as by welding or other suitable means to a curved shield member 16 which, in turn, is removably attached by fastening means such as screws 17 to a cross bar member 18 which is suitably attached to the frame structure 11 of the apparatus. The vacuum fan is driven by suitable pulley means 19 and drive motor 20 which is also mounted upon suitable support structure 21 attached to the frame 11. The flared inlet portion of the vacuum device 14 is curved back upon itself so that the air inlet openings draw air from the direction of the storage chute member 6, as clearly shown in FIG. 8. As may be clearly appreciated from FIG. 8, the vacuum device is adapted to draw each individual envelope flap which passes thereover for the purpose of opening same whenever the vacuum device is operative.

The feeding section 3 of the apparatus will now be described. Rotatably mounted upon a shaft 22 are a pair of spaced apart drum members 23. In the alternative, a singular continuous drum member extending completely laterally across the apparatus could be utilized instead of the separate drum members 23. Such drum members are keyed or splined to the shaft 22 which shaft is journaled for positive rotation within suitable bearing means within the apparatus frame structure 11. The drum members 23 may be solid in section or may be hollow members which are connected to the shaft 22 by means of welding or the like or which may be made from such rigid materials as metal or high strength plastic.

Disposed fixedly upon each of the drum members 23 is a gripper segment 24. Such gripper segments are made from resilient material such as rubber, soft fluro-carbon, polyethylene foam, or the like, and are attached to the drum members 23 by positive means such as glue, rivets, or holding pad and slots cut into the drum members. Each segment has an included angle $\alpha$ of approximately 60° to 85°. The gripper segments are provided with a plurality of finger like projections 25 which, as shown in FIGS. 1 and 8, are disposed in double rows having four projections each. While this particular arrangement has proven to provide optimum results, it should be understood that other numbers and arrangements of projections on the gripper segments may be provided. For instance, diamond shaped or criss-crossed configurations would, in some cases, produce very favorable results. As will be explained more fully hereinafter, the function of these gripper segments and the projections thereupon is to engage the bottom surfaces of the individual envelopes and to feed the envelopes, one at a time, into the apparatus. The shaft 22 may be rotated by suitable pulley means connected to the drive motor 20 or, alternatively, may be driven by a separate motor (not shown).

It should be noted at this point that the apparatus and the drive means therefor may be coordinated with other apparatus to perform, if desired, an entire mailing operations sequence. For example, the instant flap processing apparatus could be coordinated with an inserting machine which would receive the "flapped" envelopes upon ejection from the instant apparatus and stuff or insert the materials to be mailed therein and then feed the filled envelopes into a machine which would seal and address them. All this could be done by a computerized control system with a coordinated drive means which would properly sequence the functions of each component in the system to provide the desired end result. In this regard, the instant invention might be considered as one component of an integrated overall system for handling large volume mailing operations.

Returning to the description of the feeding section of the apparatus, the plate member 10 is provided with a pair of holding bands or "O"-rings 29. Although these holding bands have a substantially circular cross section in the preferred embodiment, other shapes are possible. The bands may be continuous as shown and may be fitted over the plate member 10 by means of the removal of the plate member from the frame 11. Alternatively, the holding bands may be separable members which are wrapped around the plate member 10 and then are connected in place. The bands are movable upon the plate member 10 to provide lateral adjustability and to compensate for wear which might occur in portions thereof. The function of the holding bands is to retard the falling of all of the envelopes residing in the storage area except for the lowermost one 28 in the stack which, when engaged by the gripper means 24, will be fed through the apparatus between the plate member 10 and the drum members 23. The holding bands are made from resilient material such as rubber or the like having an inherent semi-adhesion property which presents a frictional surface sufficient to retain all of the envelopes in place until each has dropped to the bottom of the storage section into the lowermost portion with respect to the lower section of plate member 10 and has, in fact, made contact with the drum members 23 or the gripper segments 24. The aforementioned adjustability of the plate member 10 may be utilized to vary the spacing between the holding bands 29 and the drum member surfaces to provide enough space for a single envelope to pass therebetween. This spacing will, of course, vary with the thickness of the envelope handled but it should generally be no more than enough to pass through one envelope at a time.

With concurrent reference to FIGS. 1 and 8, it will be noted that immediately downstream of the platemember 10, in the direction of movement of the envelopes, are disposed a pair of small roller members 30 mounted upon a transverse shaft 31. The purpose of these rollers is to encounter envelopes emitted from between the plate member 10 and the drums 23 and to direct such envelopes toward the ejection section 4 of the apparatus. Immediately downsteam of the small rollers 30 is a transversely disposed accessory bar 32, the purpose of which will be explained more fully hereinafter.

The ejection section 4 of the apparatus is comprised by a pair of transverse rolls or platens 33, 34. These platens are rotatably supported upon shafts which are keyed to the platens. The platen 33 is an idler member and is supported rotatably flexibly upon the support structure 11 of the apparatus. The platen 34 is a positively driven member which is also supported by the frame structure 11. The platen 33 may be biased downwardly towards the platen 34 by spring means (not shown) or, depending upon the material used for the body of the platen, may be firmly biased downwardly by its own weight into contact with the lower platen 34. The relative positions of the platens 33, 34 may of course be made adjustable by suitable means (not shown) so that the spacing therebetween may be increased or decreased as desired to accomodate different size envelopes and materials. The platen 34 may be driven by the motor 20 or may be driven by separate motor means, as desired. The platens may be made from hard rubber-like material or from metal covered with rubber padding. The speeds of the platens are controlled with respect to the previous mentioned components of the apparatus so that the linear velocity of the envelopes or other materials passing through the ejection section is slightly greater than the velocity of the envelopes passing between the plate member 10 and the drum members 23.

Up to this point, the apparatus has been described in relation to its "flapping" mode of processing operations. The apparatus is, however, equipped with means for performing other modes of operation, as will now be explained. By reference to FIGS. 4–6, one may appreciate the component parts of the stuck flap opening means of the instant apparatus. As previously discussed, envelope shipments oftimes arrive at the processing point with the gummed portions of the flaps thereof stuck firmly to the body portions of the envelopes. In such condition, the vacuum means 14 would not apply sufficient force to such flaps to open them during the "flapping" operation. In such case, the vacuum device 14 would be intentionally temporarily rendered inoperative and the apparatus would be used in its stuck flap opening mode of operation.

In the stuck flap opening mode the accessory bar 32 is provided with a knife like opening means shown generally at 40 in FIG. 4. The stuck flap opening means include a finger-like guide means 41 for guiding envelopes to be opened to a substantially pointed knife edge portion 42. The stuck flap opening means also includes a branch section 43 which limits the upward movement of flaps engaged by the knife edge portion 42. The stuck flap opening means is attached to the accessory bar 32 by removable means such as clip brackets 44, 45 which, as shown clearly in FIG. 5, are channel shaped members firmly engaging the accessory bar 32 to hold the opening means rigidly in position with respect to moving envelopes. The bracket member 44 also includes an upwardly curving guide member 46 and the bracket member 45 includes a downwardly curving guide member 47 for shepherding moving envelopes therebetween for engagement with the knife edge portion 42. In the embodiment shown, the stuck flap opening means is clipped onto the accessory bar 32 when the apparatus is operating in the stuck flap opening mode. It should be clearly understood, however, that the stuck flap opening means would be swung upwardly upon the hinge means as shown in phantom in FIG. 6 out of the path of emitted envelopes during operation of the apparatus in other than a stuck flap opening mode.

By reference to FIGS. 9–12, means for performing a flap closing mode of operation with the present apparatus may be appreciated. As in the case of the "flapping" mode and the stuck flap opening mode, it should be clearly understood that the flap closing mode is an alternative rather than successively performed operation in the present apparatus. That is, in the preferred embodiment of the apparatus the operator would choose between the three modes of operation and would adjust and set up the apparatus accordingly for that operation.

The flap closing operation would be performed upon envelopes which had already been stuffed with materials to be sent and which were fed through the apparatus from the storage section thereof. The means shown in FIGS. 9–12 would close the flaps of such envelopes preparatory to passage of such envelopes to a sealing device or other means. It will be noted that the flap closing device, shown generally at 50, would be installed upon the accessory bar 32 in a manner similar to the installation of the stuck flap opening means shown in FIGS. 4–6. Like the formerly-discussed means, the flap closing device can be mounted upon the accessory bar 32 as shown or can be slidably moved out of the way of processed envelopes to the position shown in phantom by means of the slider system shown when not in use. The means 50 may be suitably mounted upon the accessory bar 32 by means of a U-shaped screw clamp 51 which can be attached to the folding section of the closing means through the slider means.

Figure 9:
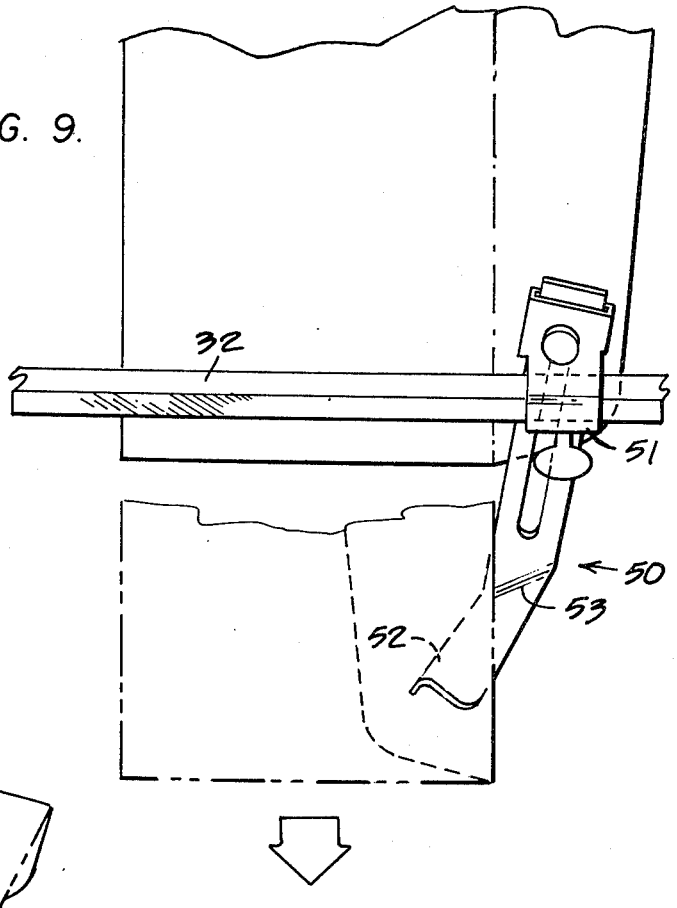
FIGS. 9–12 are various views of the flap closing means of the present invention showing its connection to the accessory bar of the instant apparatus.
Figure 10:
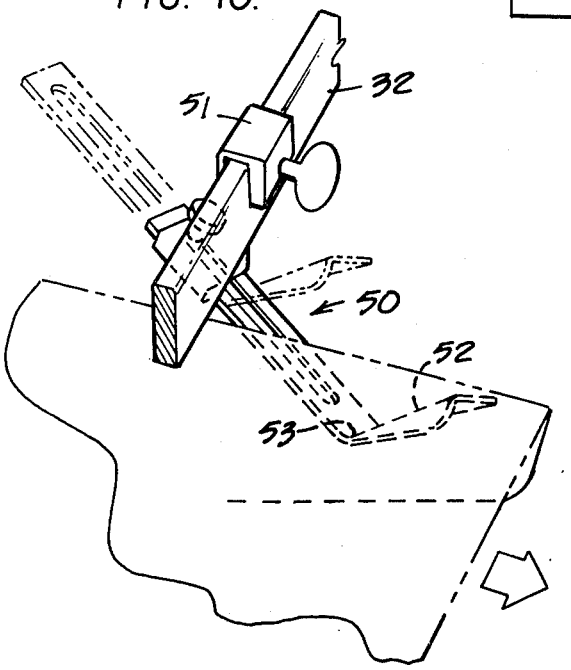
Figure 11:
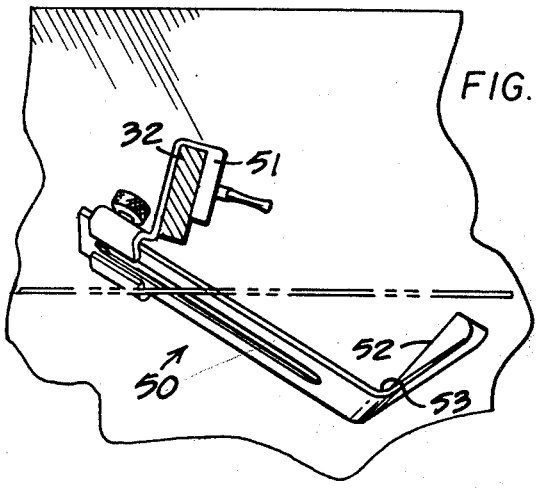
Figure 12:
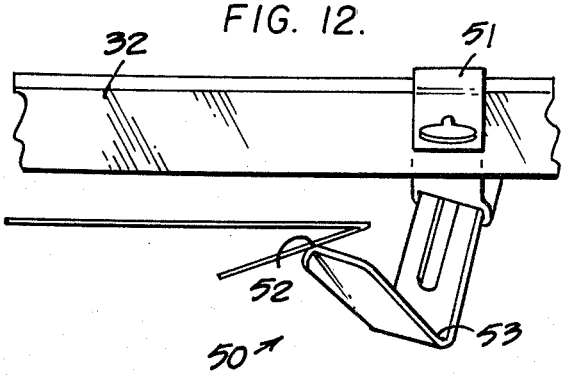

With reference to FIGS. 9–12, manner of operation of the flap closing means may be readily appreciated. The envelope travels past the flap closing means in the direction of the arrows. FIG. 9 shows an envelope in two successive positions, with the flap open in solid lines and with the flap closed in phantom. It will be noted that as the envelope flap engages the rounded edge portion 52 of the flap closing means, the flap will be driven upwardly into concurrent engagement with the underside of the accessory bar 32 by the camming action of the edge 52. The flap closing means may be fabricated from a sheet of flat material first folded at one end thereof to form the smooth edge 52 and then bent at 53, 54, and 55 to form the modified J-shape shown.

With concurrent references to FIGS. 1–3, the conveying section 5 will now be described. The conveying section, which receives material ejected from the ejection and flattening section 4, includes an elongated table-like conveying system having an elongated frame structure 60 attached to the apparatus support structure 11 by means of hooks 61 or the like and supported at one end thereof upon legs 62. The system includes a plurality of flexible conveying belts 63 which are driven continuously by suitable motor means 64 which drive a shaft 65 through suitable pulley and belt means 66. An idler shaft 67 is provided at the opposite end of the elongated frame structure to assure the smooth, continuous movement of the belts 63 in the direction of the arrows.

Because the envelopes emitted from the flattening and ejection section of the apparatus tend to shingle or overlap and to create a pile at the beginning of the conveying section, roller means shown generally at 68 are provided for pressing the individual envelopes against the moving conveyor belts 63 so that such individual envelopes are carried away from the apparatus ejection section and toward a point of use in an orderly fashion. The means 68 include a pair of weighted rollers 69 journaled for rotation upon a shaft 70 supported by a yoke 71. The yoke is fixed to a pair of rod members 72, which rod members are slidably received within a pair of upstanding pivotal brackets 73 attached to a portion of conveyor frame structure 60. The upstanding brackets include a screw thread tightener 74 and a slider block member 75 which is pivotally mounted at 76 to provide upward and downward as well as axially sliding movement of the weighted rollers 69. The conveying means is also provided with an end shield member 77 which prevents the inadvertent discharge of processed materials from the end of the conveyor system.

OPERATION

With reference to the accompanying drawings, the operation of the instant apparatus in its various processing modes will now be described.

In the flapping mode of operation, a plurality of envelopes, the flaps of which are to be opened, are placed in the storage section between the chute member and the plate member, as previously described. The chute member is adjusted rearwardly or forwardly, depending upon the size of the envelopes to be opened. It should be noted that the storage section or bin could be replaced by a continuous feed system, such as a conveyor belt of like apparatus (not shown). In the preferred embodiment, however, the envelopes, when dropped into the storage section, assume the configuration shown in FIG. 8. Upon rotation of the shaft and drum members, the gripper segments will rotate in the direction indicated to a point directly beneath the plate member. The resilient projections on the gripper means will engage the bottom surface of the lower most envelope body and, due to friction and adhesion forces, the lowermost envelope will be forced between the plate member and drum members.

As shown in FIG. 8, when given envelope is part way through the apparatus, the vacuum means inlet section engages the flap portion of the envelope, and pulls it open as the other portions of the envelope pass between the plate member and drum members. Approximately concurrently with this opening phase, the roller 30, and then the platens 33 and 34 engage the body of the envelope and pull and squeezeably flatten the envelope or other material wih considerable force. The envelopes are then projected into the conveying system which has been previously described.

In either the stuck flap opening mode or the flap closing mode, movement of the envelopes or other materials through the apparatus is as described in the "flapping" phase. However, in the latter two modes, the vacuum opening means is not utilized. Instead, either the stuck flap opening means or the flap closing means shown in FIGS. 4–6 and 9–12, respectively, are utilized.

Thus, the preferred embodiments of the invention have been illustrated and described. It must be understood that these preferred embodiments are capable of variation and modification and are not limited to the precise details set forth. For instance, instead of the mechanical feeder and ejection systems described, a completely pneumatic system could be used wherein each envelope would in effect be "pumped" through the apparatus within variable volume channels or the like. It should also be noted that the instant apparatus, while primarily intended as an envelope processing machine, also has general utility and may be used to unfold sheets of paper, cloth, or the like, which sheets have not been pre-formed into an envelope configuration. This invention includes all such variations and modifications as fall within the scope of the appended claims.

I claim:

1. A multi-component apparatus for processing envelope flaps comprising, in series; variable-capacity envelope storage means mounted upon frame means, envelope flap opening means for selectively exerting a fluid pressure force upon said flaps which means is disposed immediately adjacent to said variable capacity envelope storage means, envelope feeder means disposed immediately adjacent to said envelope flap opening means and having inlet and outlet means, said envelope feeder means being adapted to convey envelopes individually from said variable capacity envelope storage means and said envelope flap opening means to said outlet means of said feeder means, means disposed upon said frame means immediately adjacent to said outlet means for operatively supporting envelopes which have been conveyed from said outlet means of said envelope feeder means, drive means for actuating said envelope feeder means, envelope flattening and ejector means mounted upon said frame means for receiving processed envelopes which have been conveyed from said variable capacity envelope storage means to said envelope flap opening means through said envelope feeder means inlet and outlet means, said envelope flattening and ejector means being operative to apply flattening force to said envelopes which force tends to prohibit the reclosure of opened envelopes, conveying means for positively conveying processed envelopes in an orderly fashion from said apparatus to a place of utilization.

2. The invention of claim 1 wherein said variable capacity envelope storage means includes a chute member which is adjustably attached to a table portion of said frame means and wherein said chute member is normally inclined with respect to a vertical plane passing through said apparatus.

3. The invention of claim 1 wherein said envelope flap opening means include a vacuum means attached to said frame means.

4. The invention of claim 3 wherein said vacuum means includes a flared inlet portion disposed immediately adjacent to said storage means most proximate to said envelope flaps to be processed.

5. The invention of claim 4 wherein said vacuum means further include motor driven fan means for producing a low air pressure at said flared inlet portion of said vacuum means.

6. The invention of claim 1 wherein said envelope feeder means include drum member means mounted for rotation upon a portion of said frame means and wherein said drive means for said envelope feeder means rotatably actuates said drum member means.

7. The invention of claim 6 wherein said drum member means include gripper segment means fabricated from material which is semi-adhesive with respect to said envelopes which gripper segment means frictionally engage a portion of each of said envelopes to convey each said envelope from said feeder means inlet means to said feeder means outlet means.

8. The invention of claim 1 wherein said envelope flattening and ejector means include a pair of platen members disposed for rotation upon said frame means and wherein one of said platen members is actuated by drive means and wherein said platen members are normally urged toward rotative engagement with one another by biasing means.

9. A multi-component apparatus for processing folded sheet material comprising; frame means having a base portion and having other portions attached to said base portion, sheet material feeder means mounted upon said other portions of said frame means, said sheet material feeder means including drum member means mounted for rotation upon said other portions of said frame means, said drum member means having sheet material gripping means attached thereto, vacuum operated sheet material unfolding means for exerting fluid pressure upon said folded portions of said sheet material to unfold said portions, said sheet material unfolding means being disposed upon said other portions of said frame means adjacent to said sheet material feeder means, said sheet material feeder means being operative to transmit said sheet material movably past said sheet material unfolding member means, drive means for said sheet material feeder means, said sheet material storage means mounted upon said other portions of said frame means for storing said sheet material prior to admission thereof to said sheet material feeder means and said sheet material unfolding means for transmitting and unfolding said sheet material, respectively.

10. The invention of claim 9 further comprising sheet material flattening and ejector means mounted upon said other portions of said frame means which ejector means operate to transmit said sheet material away from said sheet material feeder means and said sheet material unfolding member means subsequent to the unfolding thereof and drive means for said sheet material ejector means.

11. The invention of claim 10 wherein said sheet material ejector means operates to forcibly flatten said sheet material in an unfolded condition and wherein support means are provided between said sheet material ejector means and said sheet material feeder means.

12. The invention of claim 9 wherein said sheet material feeder means further include plate means disposed upon said other portions of said frame means adjacent to said drum member means such that sheet material conveyed by said sheet material feeder means passes between said plate means and said drum member means.

13. The invention of claim 12 wherein said sheet material feeder means include sheet material holding band means mounted upon said plate means for releasably retaining sheet material prior to passage of said sheet material through said unfolding apparatus.

14. The invention of claim 9 wherein said vacuum operated sheet material unfolding means include a vacuum device disposed upon said other portions of said frame means and having a flared air inlet portion disposed proximate a folded portion of said sheet material for exerting air pressure thereupon to unfold said folded portion.

15. The invention of claim 9 wherein said sheet material gripping means include a segment member made of resilient material which extends arcuately around a portion of the periphery of said rotatable drum member means, said segment member having a plurality of sheet material engaging projections thereupon.

16. The invention of claim 13 wherein said plate means are adjustably mounted with respect to said drum member means such that the spacing therebetween can be readily varied and said sheet material holding band means are adjustably mounted upon said plate means.

17. The invention of claim 1 wherein said multi-component flap processing apparatus further includes selectively actuatable stuck flap opening means for mechanically engaging and opening envelope flaps which have been stuck-closed, said stuck flap opening means being mounted upon accessory bar means attached to said frame means.

18. The invention of claim 17 wherein said stuck flap opening means include a knife-edged member having envelope guiding means thereupon.

19. The invention of claim 18 wherein said stuck flap opening means is hingeably mounted upon said accessory bar means for selective movement of said knife-edged member into and out of the path of envelopes to be processed.

20. The invention of claim 1 wherein said multi-component flap processing apparatus further includes selectively actuatable flap closing means for mechanically engaging and closing envelope flaps which have been previously opened, said flap closing means being mounted upon accessory bar means attached to said frame means.

21. The invention of claim 20 wherein said flap-closing means is moveably mounted upon said accessory bar means for selective movement of said flap-closing means into and out of the path of envelopes to be processed.

22. The invention of claim 17 further including selectively actuatable flap closing means for mechanically engaging and closing envelope flaps which have been previously opened, said flap closing means being movably mounted upon said accessory bar means.

23. The invention of claim 1 wherein said conveying means include conveyor belt means for conveying envelopes from said ejection and flattening means to a place of utilization, said belt means being mounted for rotation upon a pair of parallel disposed and spaced apart shafts.

24. The invention of claim 23 wherein said belt means and shafts are mounted upon table-like elongated frame means and wherein drive means are provided for driving one of said shafts for rotating said belt means.

25. The invention of claim 24 wherein said apparatus includes hook fastening means for engaging a portion of said conveying means and for supporting said conveying means proximate said ejection and flattening means.

26. The invention of claim 24 wherein said conveying means further include weighted roller means for engaging envelopes to be conveyed to said place of utilization and for forceably biasing said envelopes into firm frictional engagement with said belt means.

27. The invention of claim 26 wherein said weighted roller means are adjustably moveably mounted upon said table-like elongated frame means.

* * * * *